US010188218B2

(12) United States Patent
Hyltenfeldt et al.

(10) Patent No.: US 10,188,218 B2
(45) Date of Patent: Jan. 29, 2019

(54) FURNITURE DEVICE WITH ADJUSTABLE FIRMNESS

(71) Applicant: YOU BED AB, Nacka (SE)

(72) Inventors: Stefan Hyltenfeldt, Norrtälje (SE); Mattias Sörensen, Saltsjö-Boo (SE)

(73) Assignee: You Bed AB, Nacka (SE)

( * ) Notice: Subject to any disclaimer, the term of this patent is extended or adjusted under 35 U.S.C. 154(b) by 0 days.

(21) Appl. No.: 14/889,468

(22) PCT Filed: May 7, 2014

(86) PCT No.: PCT/EP2014/059381
§ 371 (c)(1),
(2) Date: Nov. 6, 2015

(87) PCT Pub. No.: WO2014/180924
PCT Pub. Date: Nov. 13, 2014

(65) Prior Publication Data

US 2016/0073789 A1 Mar. 17, 2016

(30) Foreign Application Priority Data

May 8, 2013 (EP) ..... 13167021

(51) Int. Cl.
*A47C 23/04* (2006.01)
*A47C 27/06* (2006.01)
(Continued)

(52) U.S. Cl.
CPC ..... *A47C 27/061* (2013.01); *A47C 7/345* (2013.01); *A47C 27/064* (2013.01); *A47C 27/0456* (2013.01); *A47C 27/06* (2013.01)

(58) Field of Classification Search
CPC ..... A47C 27/061; A47C 27/064; A47C 7/345; A47C 27/07; A47C 27/06; A47C 27/0456
See application file for complete search history.

(56) References Cited

U.S. PATENT DOCUMENTS 2,673,357 A * 3/1954 Brandwein ..... A47C 27/061 116/278
4,222,137 A * 9/1980 Usami ..... A47C 23/0435 5/697

(Continued)

FOREIGN PATENT DOCUMENTS

EP 2245967 A1 11/2010
WO 2005053466 A1 6/2005
WO WO 2005053466 * 6/2005 ..... A47C 27/08

OTHER PUBLICATIONS

Extended European Search Report dated Jul. 29, 2013 for EP Application No. 13167021.8, 6 pages.

(Continued)

*Primary Examiner* — Nicholas F Polito
*Assistant Examiner* — Morgan J McClure
(74) *Attorney, Agent, or Firm* — RMCK Law Group, PLC

(57) ABSTRACT

The invention relates to a furniture device configured to receive the weight of a being, said furniture device having a holding arrangement (20) and at least one section (30). The section (30) comprises a base (2), a movable plate element (6), a moving mechanism (4) and at least one elastic device (12). The plate element (6) is configured to interact with the at least one elastic device and to be moved by the moving mechanism in respect to the base in order to adjust the firmness of the at least one elastic device. The elastic device comprises a pocket (14) made of a fabric, and an elastic member (18), the elastic member is arranged within said pocket, the pocket is attached to adjacent pockets whereby the attachment (32, 32') is formed so that adjacent elastic devices may move independently from one another along a distance (A), as measured from a free end of the elastic device and in a direction perpendicular to the plate member. The holding arrangement comprises a connecting portion (Continued)

(26) and a holding member (22), which is connected to the at least one elastic device via the connecting portion, such that the at least one elastic member is compressed and relaxed over its entire length during movement of the plate element in a respective direction, wherein the connecting portions are arranged on a straight line, which extends through the center of two or more attached elastic devices.

15 Claims, 4 Drawing Sheets

(51) Int. Cl.
*A47C 7/34* (2006.01)
*A47C 27/045* (2006.01)

(56) References Cited

U.S. PATENT DOCUMENTS 6,371,458 B1 * 4/2002 Stjerna ..... A47C 27/063 267/91
7,458,121 B1 * 12/2008 Hsu ..... A47C 23/0435 5/697
8,613,119 B2 * 12/2013 Hsu ..... A47C 23/0435 5/600
2010/0212090 A1 * 8/2010 Stjerna ..... A47C 27/064 5/720
2012/0042454 A1 * 2/2012 Viberg ..... A47C 23/0435 5/727
2015/0171703 A1 * 6/2015 Viberg ..... A47C 20/041 310/83

OTHER PUBLICATIONS

PCT International Search Report dated Sep. 1, 2014 for PCT International Application No. PCT/EP2014/059381, 2 pages.
Australian Examination Report for Application No. 2014264588 dated Nov. 21, 2017, 4 pages.
New Zealand Examination Report for Application No. 714858 dated Nov. 27, 2017, 3 pages.

* cited by examiner

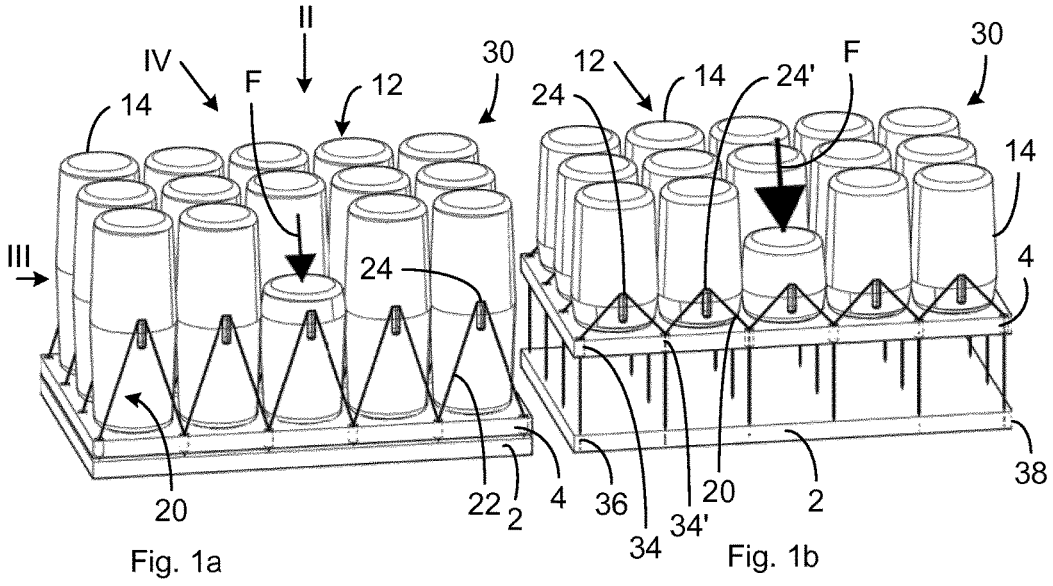
Fig. 1a
Fig. 1b
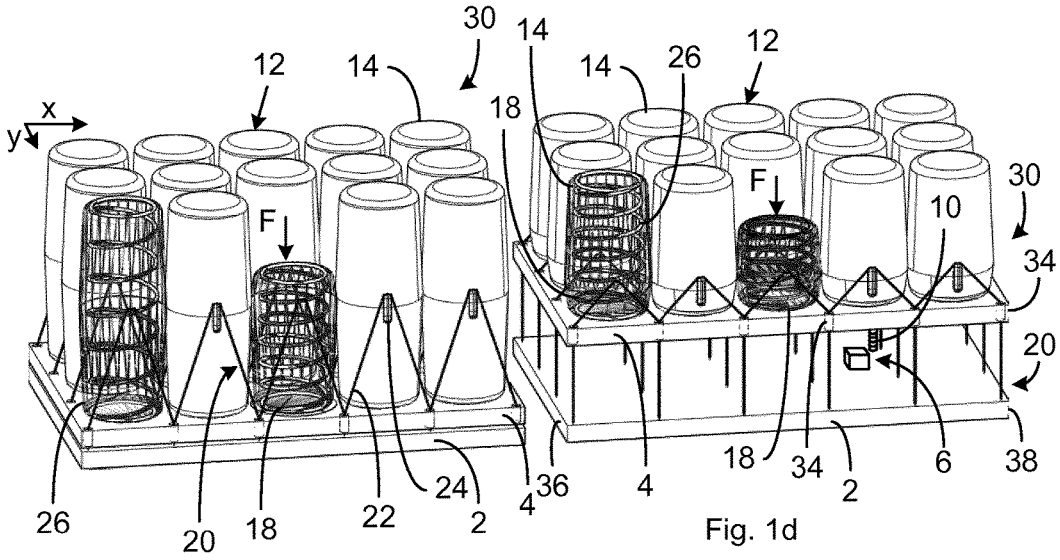
Fig. 1c
Fig. 1d

FURNITURE DEVICE WITH ADJUSTABLE FIRMNESS

CROSS-REFERENCE TO RELATED APPLICATIONS

This application is a 371 U.S. National Stage of International Application No. PCT/EP2014/059381, filed May 7, 2014, which claims priority to EPC No. 13167021.8, filed May 8, 2013. The disclosure of each of the above applications is incorporated herein by reference in their entirety.

TECHNICAL FIELD

The invention relates to furniture device, such as a bed or mattress, a seat cushion or the like, adapted to receive the weight of a being. The device having a holding arrangement and at least one section comprising a base, which is configured to be supported by the ground, a movable plate element, which is connected to the base via a moving mechanism and at least one elastic device. The plate element is configured to interact with at the least one elastic device and to be moved by the moving mechanism in respect to the base in order to adjust the firmness of the elastic device and thus of the section. The elastic device comprises a pocket made of a fabric, and an elastic member which is arranged within said pocket. The pocket is attached to adjacent pockets via the fabric. The attachment between two adjacent pockets being formed so that the elastic devices may move independently from one another along a distance as measured from the free end of the elastic device and perpendicular to the plate element. The holding arrangement comprises a connecting portion and a holding member, which is connected to the at least one elastic device via the connecting portion. The connecting portions are arranged on a straight line, which extends through the centre of two or more attached elastic members.

BACKGROUND

A furniture device, such as a bed or mattress, a seat cushion, or other device, is provided to act on the weight or part of the weight of a being, wherein the device distributes the weight of the body of the being over a part of a surface of the furniture device. Depending on how the device distributes the weight of the being, it will appear as soft or firm. The degree of firmness of such a furniture device is dependent on the properties of the elastic element, such as for example the spring constant or the air pressure. Another parameter that influences the degree of firmness is the arrangement of the elastic element or elements in the furniture device; a pre-tensioned helical spring is harder than a free helical spring, same for an air cushion that is compressed; it is harder than a loose air cushion. Thus the firmness of a furniture device such as a mattress is usually set during manufacturing.

In known furniture devices with properties according to the field of the invention, the firmness of the device is adjustable by deforming the elastic members and thus pre-tensioning them. A mechanism comprising a deformation member, which is capable of deforming the elastic members is used to adjust the firmness of the device or mattress. The firmness of such furniture devices may be adjusted by the being or the user, even after manufacturing of the device. The firmness of the elastic members may also be adjusted when the furniture is used over a period of time allowing compensating for possible changes of its properties.

Contemporary furniture devices with the above described properties often comprise elastic members with a so called pocket spring design, wherein each elastic member comprises a spring element and a flexible envelope that encloses the spring so that the spring is caught in the flexible envelope. Such pocket spring designs allow each spring to deform itself without affecting the adjacent springs. However, the known pocket spring design mattresses cannot be combined with mechanisms that allow the adjustment of the firmness of the spring without loosing the ability to deform itself without affecting the adjacent springs.

WO2005/053466 discloses an upholstered unit such as for example a bed or mattress including a plurality of pocketed springs and at least one inflatable member located above and/or below of at least some of the pocketed springs. WO2005/053466 discloses the use of an inner pocketed spring arranged within an outer pocketed spring, whereby these pocketed springs may be arranged on an inflatable member. The build up of the upholstered unit according to this disclosure is complicated, heavy and due to the many inflatable members proposed also prone to failure.

EP2245967 A1 discloses a furniture device adapted to receive the weight of a being, comprising a section with a fundament, a plate member and a set of elastic members. The elastic members are connected to the fundament via an array of connections, a net member and connection members and they are embedded on the plate member. The plate member is arranged above the fundament with respect to the ground and it can be displaced by a deformation member, thereby pre-tensioning the elastic members. The elastic members comprise an elastic element and a flexible envelope embedding the elastic element. The connection members are attached to the net members and the net member is attached to the array of connections. The net member is a solid grid shaped element. The use of a net member enhances the complexity of manufacturing, build-up and the weight of the furniture device. Further, when the weight of a being acts on the device, it may affect adjacent areas on the same section or neighbouring sections of the device via the net member, since this net member is preferably a solid grid.

OBJECT AND SUMMARY OF THE INVENTION

An object of the present invention is to provide an enhanced furniture device which allows adjustment of the firmness.

A further object is to provide such a furniture device at which deformation induced by a being to one elastic device of the furniture device does not influence neighbouring elastic devices.

Another object is to provide such a furniture device at which the firmness of the elastic devices may readily be adjusted with a high degree of accuracy.

Yet another object is to provide such a furniture device that is easy to handle, comparably light and easy to manufacture.

Another object of the present invention is to provide a furniture device that is economical.

Another object of the present invention is to provide a furniture device that is sensitive in use.

These objects are achieved by a furniture device according to claim 1.

Disclosed herein is a furniture device configured to receive the weight of a being, said furniture device having a holding arrangement and at least one section comprising a base, a movable plate element, a moving mechanism and at least one elastic device. The plate element is configured to interact with at least one elastic device and to be moved by the moving mechanism in respect to the base in order to adjust the firmness of the at least one elastic device. The elastic device comprises a pocket made of a fabric, and an elastic member, the elastic member being arranged within said pocket. The pocket is attached to adjacent pockets whereby the attachment is formed so that adjacent elastic devices may move independently from one another along a distance, as measured from a free end of the elastic device and in a direction perpendicular to the plate member. The holding arrangement comprises a connecting portion and a holding member, which is connected to the at least one elastic device via the connecting portion, such that the at least one elastic member is compressed and relaxed over it's entire length during movement of the plate element in a respective direction The connecting portions are arranged on a straight line, which extends through the centre of two or more attached elastic devices.

Connecting the holding members to the connecting portions has the advantage that no additional element is needed. That eases the manufacturing and reduces the weight of the bed. In addition it enhances also the sensitivity and reduces the influence on neighbouring sections and individual elastic devices, when the weight of a being is affecting a section or part of a section of the furniture device.

In addition, the arrangement of the connection portion and the holding member, such that the entire length of the elastic member is affected by the movement of the plate member, enhance the accuracy by which the firmness of the furniture device may be adjusted.

In an advantageous embodiment the holding member may be connected to the base.

The holding member may be a thread or string passing through recesses in the plate member. The plate member may be arranged above the base in respect to the ground. The holding member may be fixed to the base and/or the connecting portions and/or the plate member via knots at the two ends and waving through base, plate member and connecting portions in between the two ends. The plate member may be displaced by the moving mechanism away from the base and the ground so that the holding members keep the elastic device in the original position so that the plate element is thus pre-tensioning the elastic devices when it is displaced.

In another, alternative embodiment the holding member may be connected to the plate element.

In such an embodiment, the elastic devices may be arranged on the base and the plate element below the base in respect to the ground. The holding member may pass through recesses in the base and it may be fixed to the plate element at the two ends and waving through plate element, base, and connecting portions in between. Fixing the ends to either the connecting portions or the base is also possible. The plate element may be configured to be displaced away from the base towards the ground by the moving mechanism in order to pre-tension the elastic devices. In this case the moving mechanism only works against the elastic force of the elastic device.

Multiple holding members may be arranged on one section. They may also be arranged in multiple directions on the plate element or base.

Advantageously the elastic members are helical springs and the connecting portions may be arranged on a straight line, which extends through the centre of the helical springs.

The helical springs may be made of metal or alternatively of a plastic. Helical springs have good elastic properties and they are easy to obtain and install.

In an advantageous embodiment the elastic device may have a length, as measured perpendicular to the plate member, whereby the distance, is bigger or equal to 1/15 of the length and smaller or equal to 2/3 of the length.

This ensures that adjacent elastic devices can move independently from one another and that in case the weight of a being is acting on the furniture device or a section of it, a neighbouring being is not disturbed.

In another embodiment the holding member may be a string that connects multiple connecting portions.

A string or thread or the like is flexible, soft and easy to handle and install. The string may be made of cotton or a synthetic material.

In another embodiment the connecting members may be passages in the pocket, welding seams and or glued seams. It is possible to combine combinations of different types of connecting portions in one single section. There may be welding seams used in one horizontal direction and glued seams in another direction. It is also possible to use recesses, cut outs or through holes in the pockets and to guide the holding member through those recesses, for example around the edge of a section.

Using different types of connecting portions has advantages during the manufacturing of the furniture device and it may also be advantageous regarding the durability of the furniture device. In case one piece of fabric is used to produce a plurality of pockets, the welding seams may be established during the manufacturing of the pockets, namely when the fabric is welded together to form pockets.

In another embodiment the connecting portions are directly formed on the elastic member.

In such an embodiment, the connecting members may be directly fixed to the elastic members. Such direct fixing can be advantageous for the durability of the furniture device, since it may reduce the wear of the pockets.

In an advantageous embodiment, the elastic device comprises more than one elastic member and correspondingly more than one pocket, the elastic member and corresponding pocket being arranged on top of one another.

This enhances the sensitivity of the furniture device and enables a user to adjust the firmness in a fine manner over a certain range.

Advantageously the pockets are welded together in one horizontal direction and glued together in another horizontal direction.

Using different types of attachments between pockets can be advantageous when rows of elastic devices are attached together. As described above, it is possible to use one fabric to embed more than one elastic member, thereby forming a row of elastic devices and thus the pockets may be connected to one another by welding in one direction and by gluing in the other direction.

Advantageously the furniture device may be a bed or mattress comprising a plurality of sections.

Such a bed or mattress may have advantages when it has to be used for various users, such as for example in hotels. Another application may be the treatment of patients with back or hip problems, since the sections allow it to harden the mattress, for example in the area of the buttock and shoulder to straighten the back and hip, thereby allowing to adjusting the mattress for every patient.

In another embodiment the pockets are attached to adjacent pockets in a manner so that they are not attached to one another along a distance as measured from the plate member in a direction perpendicular to the plate member and wherein the distance is bigger or equal to 1/15 of the length of the elastic device. The pockets are thus basically only attached to a neighbouring pocket in the region of a mid section.

This ensures that the adjustment of the firmness of one section does not influence the neighbouring section, especially in case the one section only comprises a singular elastic device.

In an embodiment, each section may comprise a singular elastic device.

This enables the user to adjust the firmness of the section in a very fine manner.

In an advantageous embodiment the section comprises a layout of 6 times 13 elastic devices.

It is clear for the person skilled in the art, that this size or arrangement depends on the width and length of the bed or mattress or the furniture device in general. The section may also have another layout, for instance the whole mattress may be made of one section. It is clear that any other arrays are incorporated in the scope of the present invention.

Advantageously, the holding member is weaving from one connecting portion through the plate member to the base, where it is attached to the base and back through the plate member to another connecting portion and so on.

In this case the holding member may preferably be a string. Such a weaving arrangement has the advantage that the manufacturing is comparably easy and efficient.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which:

FIG. 1*a* is a perspective view of a section of a furniture device illustrating an embodiment of the invention;

FIG. 1*b* is a perspective view similar as FIG. 1 but with a plate member displaced;

FIG. 1*c* is a similar view as FIG. 1*a* with two elastic members visible;

FIG. 1*d* is a similar view as FIG. 1*b* with two elastic members visible;

DETAILED DESCRIPTION

Figure 2:
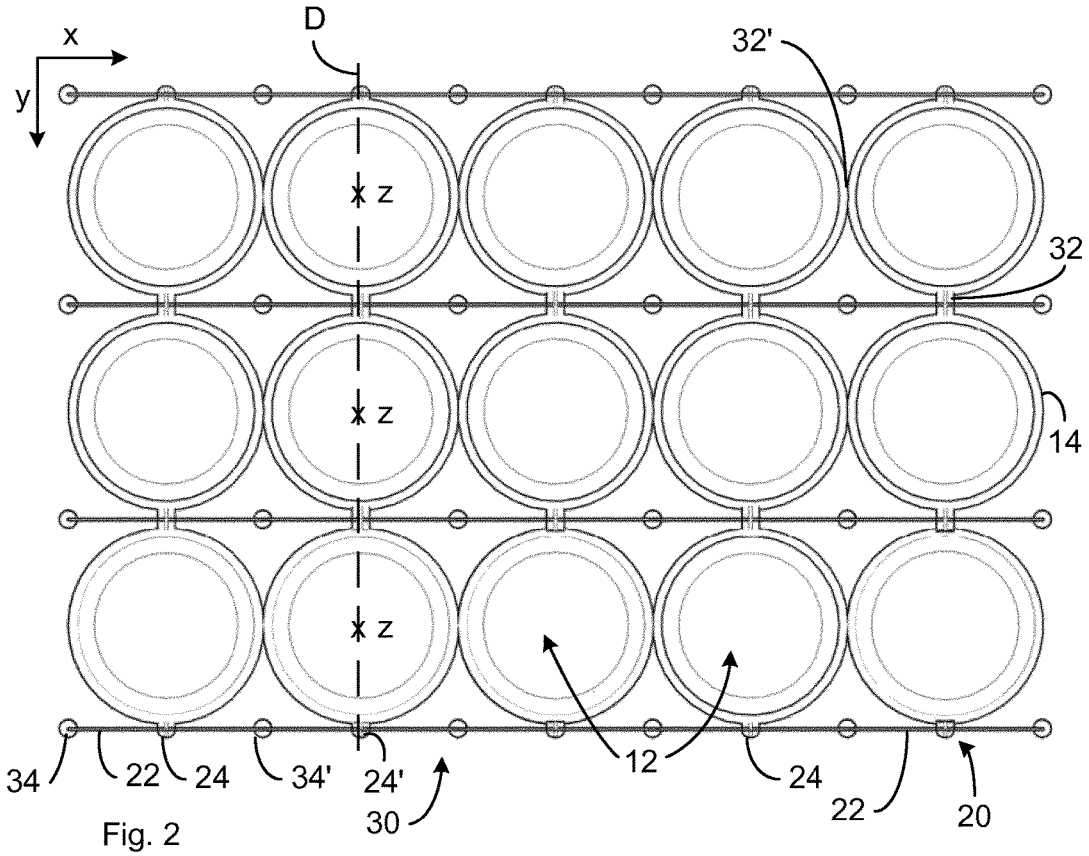
FIG. 2 is a top down view along the arrow II of FIG. 1*a;*

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

FIGS. 1*a* to 5*b* disclose a section 30 and a holding arrangement 20 of an embodiment of the invention. The section 30 may form a part of a furniture device such as a bed-mattress, a sofa or any other upholstered furniture device. The section 30 of the furniture device comprises a base 2, a movable plate element 4, a moving mechanism 6 and at least one elastic device 12, as illustrated in the FIGS. 1*a* to 5*b*. The movable plate element 4 carries and embeds a plurality of elastic devices 12. The amount of elastic devices 12 per section 30 can vary from 1 to a high amount such as for example 400 elastic devices 12 or even more. In the figures an embodiment with 5×3 (thus 15) elastic devices 12 per section and an embodiment with one elastic device 12 per section (FIGS. 5*a* and 5*b*) are illustrated.

Figure 5A:
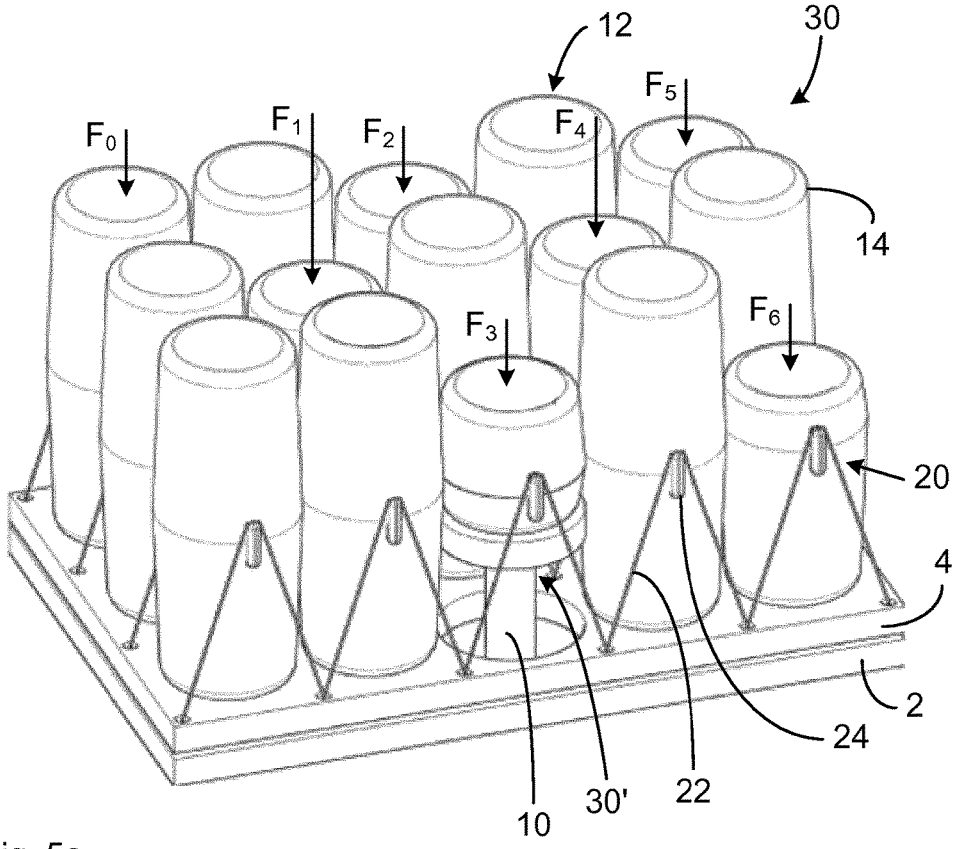
FIG. 5*a* is a perspective view of another embodiment of the invention.

The section 30 is configured to receive the weight of being. The weight of being results in a force F, schematically indicated in FIGS. 1*a* to 1*d* and FIG. 5*a*. FIG. 5*a* schematically illustrates how forces with different values $F_0$, $F_1$, $F_2$, $F_3$, $F_4$, $F_5$ and $F_6$ affect the elastic devices 12. $F_0$ has the value zero, thus illustrating the elastic device 12 in the state of rest.

The elastic devices 12 may be fixed to the plate element 4 or arranged standing freely and being held only by the holding arrangement 20 on the plate element 4. The holding arrangement 20 is configured to hold the elastic devices 12 in place, thus it is not necessary to fix the elastic devices 12 to the plate element 4.

Figure 3:
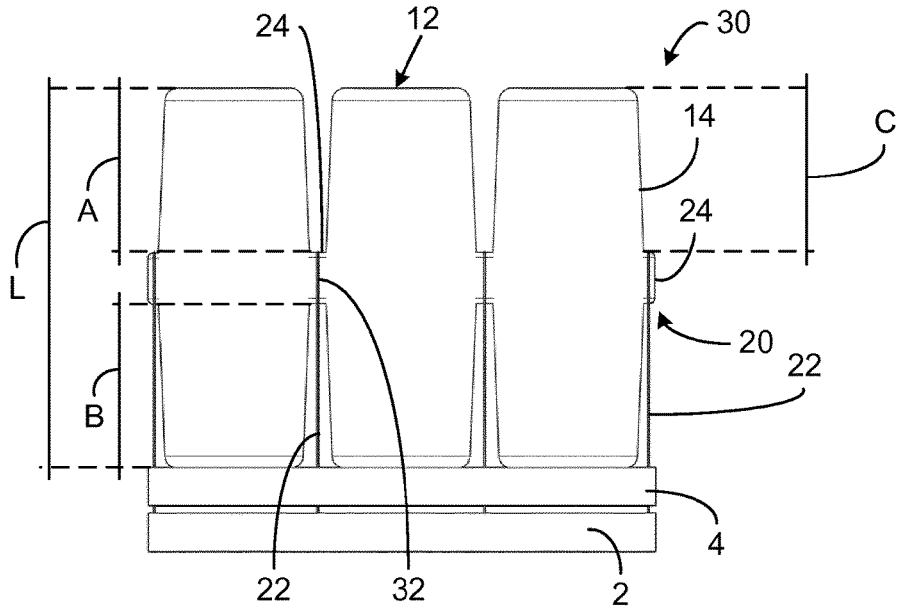
FIG. 3 is a side view along the arrow III of FIG. 1*a;*
Figure 4:
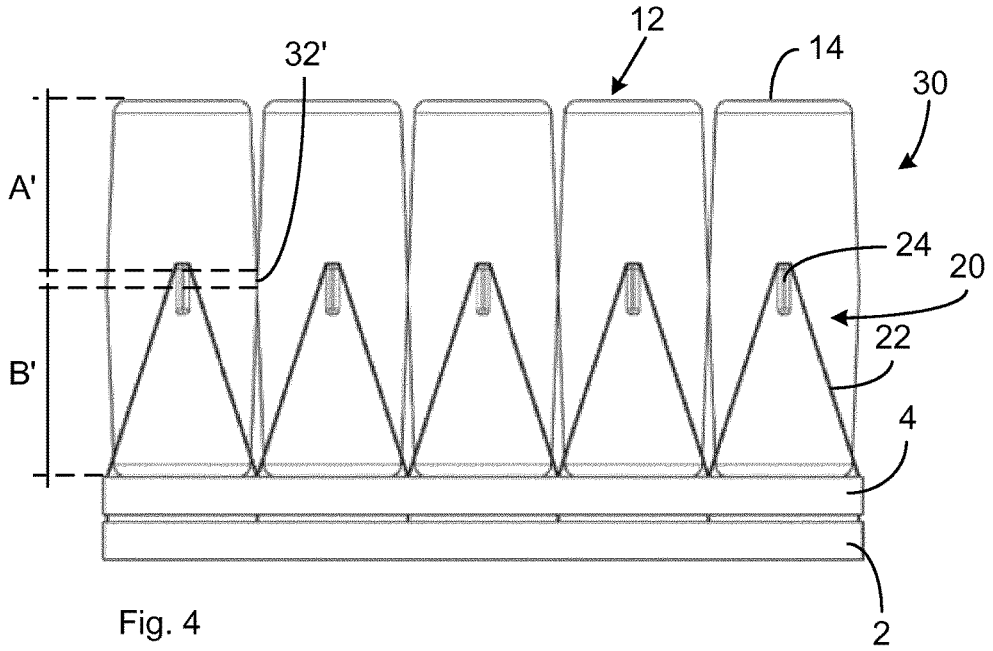
FIG. 4 is a back side view along the arrow IV of FIG. 1*a;*

The holding arrangement 20 comprises a holding member 22 and a connecting portion 24, as best seen in FIGS. 2 to 4. The holding arrangement 20 holds each elastic device 12 in position and limits the vertical movement of the upper most portion of the elastic device 12 when the plate element 4 is moved or displaced in a direction perpendicular to the base 2, such as illustrated in FIGS. 1*b*, 1*d*. When the plate element 4 is moved or displaced in respect to the base 2, then the elastic devices 12 are pre-tensioned. Moving the plate element 4 thus allows adjusting and changing the firmness of the section 30. A displaced plate element 4, as illustrated in FIGS. 1*b* and 1*d* has the effect that the firmness is harder than when the plate element 4 is not displaced, thus when it is in the original position.

Figure 5B:
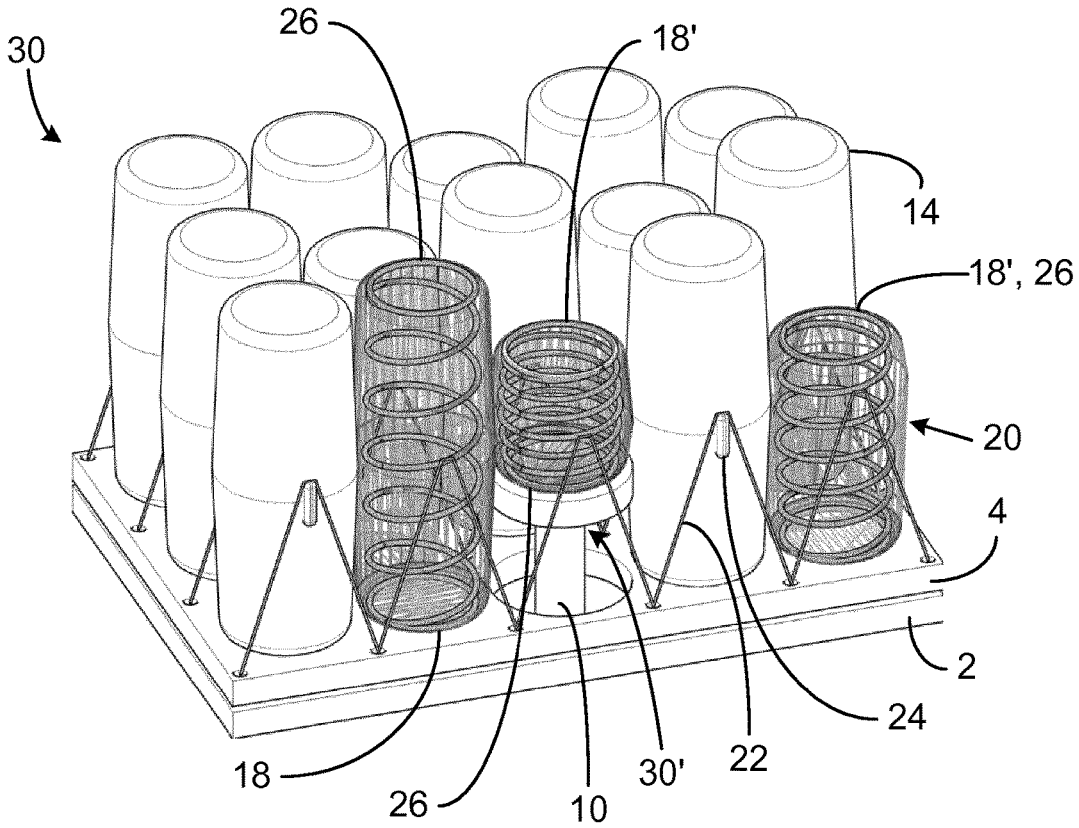
FIG. 5*b* is a perspective view similar as FIG. 5*a*, with some elastic members visible.

The elastic devices 12 comprise a pocket 14 and, embedded in the pocket 14, an elastic member 18. The pocket 14 may be made of a fabric such as cotton or preferably, a synthetic fabric that can be welded together by a suiting machine. The elastic member 18 is best illustrated in FIGS. 1*c*, 1*d* and 5*b*. In the illustrated embodiment, the elastic member 18 is a helical spring 26, for example made of metal or plastic.

The pockets 14 may be attached to adjacent pockets 14 by welding or gluing, thereby forming an attachment 32, 32' as best shown in FIGS. 3 and 4. In the shown embodiment, the pockets are welded together in one direction (Y) and glued together (X) in the other direction, as illustrated in FIGS. 1*c*, 3 and 4. It is possible and within the scope of the invention to use the same method for attaching the pockets 14 to one another in both directions. The attachment 32 between two pockets 14 may be used to connect the holding member 22 to the elastic device 12, however this is not mandatory. It is possible to connect the holding member 22 to the elastic device 12 separately from the attachment 32, as will be discussed below.

The connecting portion 24 may be formed either on the pocket 14 as illustrated in FIGS. 1-5*b* or directly on the elastic member (not shown in figures). In the later case, the connecting portion should be formed in the uppermost portion of the elastic member. Each elastic device 12 may comprise one or more connecting portions 24. In the embodiment shown in the figures, each elastic device 12 comprises two connecting portions 24. In case the holding member 22 is connected to the elastic member 18, one connecting portion 24 per elastic device 12 may be enough, especially when the holding member 22 is connected centrally to the elastic member 22.

The connecting portions 24 of a section 30 are arranged so that they are situated on a straight line D that extends through the centres Z of attached and adjacent elastic devices 12, as best illustrated in FIG. 2. The straight line D may be oriented in the horizontal Y-direction, the horizontal X-direction or it may be oriented diagonally. In case only one connecting portion 24 or in case a plurality of connecting portions 24 is/are provided for each elastic device 12, the connecting portions 24 of adjacent elastic devices 12 may always be arranged so that a line D that extends through the centers Z of the elastic devices also extends through the connecting portions 24 of adjacent, attached elastic devices 12.

When the holding member 22 is connected directly to the elastic member it is theoretically possible to provide a section 30 without pockets 14 and form the attachment between adjacent elastic members 18, however since open helical springs may affect and destroy the fabric in contact with them, for example due to sharp edges, it is advantageous to use pockets 14 to reduce the wear of the furniture device.

The elastic member 18 is free to move within the pocket 14 and its movement is only restricted by the upper part of the pocket 14 in connection with the holding member 22. The elastic member 18 may not have any lateral engagement, for example friction, such as with the pocket 14 or adjacent elastic devices 12. In case the holding member 22 is directly connected to the elastic member 18, the movement of the elastic member 18 is directly restricted by the holding member 22.

The moving mechanism 6 may comprise a mandrel 10 and drive combination, whereby the drive may be an electric motor connected to the mandrel 10 for example via a belt or chain or the like. The moving mechanism 6 may comprise more than one mandrel 10 so that the plate element 4 can be displaced symmetrically. The drive or electric motor may comprise a user interface configured to control the displacement of the plate member 4.

In the embodiments shown, the holding member 22 is a continuous string or thread connected to a plurality of connecting portions 24. The holding members 22 may extend along the X-direction and connect a plurality, in the present case five, of elastic devices 12 via the connecting portions 24. It is possible to have additional holding members 22 extending in the Y-direction thus having holding members 22 in the X- and Y-direction. Alternatively it is also possible to only have holding members 22 extending in the Y-direction. The connecting portion 24 may need to be arranged accordingly, so that they are arranged on a line D, which extends through the centres Z of the elastic devices 12.

The holding member 22 is connected to the base 2 with a first end 36 and then guided up through a recess 34 in the plate element 4 to the connecting portion 24, down through the next recess 34' to the base 2 and therefrom up through the same recess 34' to the next connecting portion 24' and so on, weaving from one connecting portion 24 to the next connecting portion 24' and so on, as best illustrated in FIGS. 1*b*, 1*d* and 2. The base 2 may comprise orifices or grommets (not shown) used to attach the holding member 22 to the base 2. The holding member 22 may be connected to the base 2 with a second end 38, as illustrated in FIG. 1*b*. At the first end 36 and the second end 38, the holding member 22 may be rigidly fixed to the base 2, which means that it cannot be moved along its longitudinal, whereas in between these first and second ends 36, 38 the holding member 22 may be loosely attached to the base 2, which means that the holding member 22 is connected to the base 2 so that it may move along its longitudinal direction, for example by using grommets or the like. Alternatively the holding member 22 may also be rigidly fixed to the base 2 in between the first and second ends 36, 38.

In case the connecting portions 24 are welded or glued the holding member 22 may be guided around these weldings or gluings, as illustrated in the figures. In an alternative embodiment the connecting portions 24 may comprise passages in the pocket 14 and the holding member 22 may be guided through said passages (not shown). Various combinations of different types of connecting portions 24 may be used in one single section 30. The type of connecting portion 24 used may also depend on the manufacturing of the section 30.

The attachment 32, 32' between pockets is best illustrated in FIGS. 3 and 4. In the X-direction the pockets 14 may be attached differently to adjacent pockets 14 than in the Y-direction. FIG. 3 illustrates the attachment 32 in the Y-direction, this attachment 32 is done by welding two layers of fabric together and FIG. 4 illustrates the attachment 32' in the X-direction, which is done by gluing using adhesive or a glue or the like.

Turning now to FIG. 3, it can be noted and seen that the attachment 32 is done in a mid-section of the elastic device 12. The attachment 32 may comprise a grommet or the like to securely guide the holding member 22. In order to ensure a proper functioning of the furniture device, the elastic devices 12 may not be attached to adjacent elastic devices 12 all the way, which means, that the elastic devices 12 are kept free and independent from adjacent elastic devices 12 in an upper end region, which extends from the free end of the elastic device 12. Each elastic device 12 is thus able to move freely and independently from adjacent elastic devices 12 along a distance A as measured from the free end of the elastic device 12 to the upper end of the attachment 32. Further, each elastic device 12 is also able to move freely and independently from adjacent elastic devices 12 along a distance B as measured from the plate element 4 towards a lower end of the attachment 32. The attachment 32 shown in FIG. 3 is preferably a welded attachment 32, whereby it is formed by welding two layers of fabric, used for forming and manufacturing the pockets 14, together. Keeping the elastic device 12 free from any attachment 32 along a distance B ensures that the firmness of two adjacent sections 30 of a furniture device can be adjusted independently from one another.

The distance A may be larger or equal to 1/15 of the total length L of the elastic device 12 and smaller or equal to 2/3 of the length L. The distance B may be larger or equal to 1/15 of the total length L of the elastic device 12 and preferably smaller or equal to 2/3 of the total length.

Distance C, as measured from the free end of the elastic device 12 to the upper end of the connecting portion 24, indicates where the connecting portion 24 is arranged, as illustrated in FIG. 3. C may be equal to or larger than zero and it does not necessarily need to correspond to the distance A, which is measured between the upper end of the attachment 32 and the free end of the elastic device 12. The holding member 22 may be connected to the elastic device 12 at a point or in a region that differs from the attachment 32, 32'.

FIG. 4 illustrates the attachment 32' in the X-direction. This attachment may be a glued attachment 32'. The distances A' and B' correspond to the distances shown in FIG. 3, however they do not need to be the same, which means the distance A between the upper end of the glued attachment 32' and free end of the elastic device 12 and the distance A' between the upper end of the welded attachment 32' and the free end can be and most likely will be different from one another. The same is valid for the distance B and B'; the distance B between the lower end of the welded attachment 32 and the plate member 4 and the distance B' between the lower end of the glued attachment 32' and the plate member 4 can be and most likely will be different from one another. Both distances A and A' should be equal or larger than 1/15 and smaller or equal to 2/3 of the length L of the elastic device and the distances B and B' should be equal or larger than 1/15 of the length L.

It is to be noted that the smallest distance of A and A' determines the distance along which an elastic device 12 can be compressed independently from an adjacent elastic device 12, thus without influencing adjacent elastic devices 12, when the weight of a being is acting on the furniture device. Further, the smallest distance of B and B' determines the how the displacement of the plate element 4 and a displacement of a plate element of an adjacent section may differ.

FIGS. 3 and 4 illustrate that the elastic devices 12 and thus the pockets 14 and the elastic members 18 bulge in the middle. This may be advantageous for establishing the attachments 32, 32', however, the elastic devices 12 may be in the shape of a symmetrical cylinder or any other suitable shape and thus not bulging in the middle.

The welded attachment 32 may be formed during the manufacturing of the elastic device 12. Thereby a plurality of elastic members 18 may be arranged on a comparably large fabric, then the fabric may be folded on top of the elastic members 18 in order to cover them and in a next step a welding machine or the like may be used to establish welding seams in between the elastic members 18 in order to enclose the said elastic members 18 in pockets 14. The welding machine may be configured to additionally separate the pockets from one another where it is needed in order to establish the free distances A and B as described above. A plurality of such welded rows of elastic devices 12 may then be glued together to form an array of elastic devices 12, which array may be used for and installed on a section 30.

FIGS. 5*a* and 5*b* illustrate a section 30 with a plurality of elastic devices 12 and therein integrated a section 30" comprising a singular elastic device 12. The distance B, B' (not illustrated in FIGS. 5*a* and 5*b*) should in this case preferably be larger or at least equal to 1/15 of the length L of the elastic device 12 in order to enable the section 30' comprising the singular elastic device 12 to move independently from the section 30 comprising the plurality of elastic devices 12. The embodiment shown in FIGS. 5*a* and 5*b* may comprise a moving mechanism 6 comprising for example a gearing mechanism or multiple drives so that the section 30' may be displaced independently from the section 30. A mandrel 10 may be used to displace the section 30' via the drive. The integrated section 30' may also be a row or column of a plurality of elastic devices 12. The section 30' may have any other shape. Integrating a section 30' in another section 30 may have the advantage to adjust the firmness of the furniture device in various areas for specific needs.

FIGS. 1*c*, 1*d* and 5*b* illustrate how the elastic members 18 are compressed or pre-tensioned within the pocket 14. For illustration purposes the pockets 14 are made transparent. The compressed elastic members 18' have different properties than the non-compressed elastic members 18, as previously mentioned. Compressed elastic members 18' are generally harder than non compressed elastic members 18, thus a user can adjust the firmness of a mattress by displacing the plate member 4 of a section 30, 30' by using the user interface which is connected to the drive.

In alternative embodiment (not shown) the plate member may be arranged below the base in respect to the ground and it may be configured to be displaced towards the ground. In such an alternative embodiment, the elastic devices may be embedded on the base and the base may comprise recesses through which the holding members may be guided to be connected to the plate member in this case. In such a solution the plate element may move the holding members, which then pre-tension the elastic devices, whereas the elastic devices are stationary and embedded on the base. In such an embodiment the holding member may be connected to the plate member with a first end and then be guided through the base to the connecting portion then back through the base to the plate element back through the base to the next connecting portion weaving from connecting portion to the next connecting portion and so on. Such an embodiment of the section may preferably be used for a bed or mattress comprising only one single section, since the displacement of the plate element actually causes a change of the level or height of the upper surface of the section and thus the mattress. In addition, it is possible with such an embodiment, to adjust the height of the upper surface of a furniture device, such as a mattress for example.

The section 30, 30' may be installed in a mattress of a bed in a sofa or in a special medical device or medical bed. A furniture device may comprise one or more than one section 30 and it is also conceivable to combine a described embodiment of a section 30 with a conventional mattress so that a user may adapt and modify her/his furniture device, even after buying it.

Further, the embodiments shown in the figures comprise one layer of elastic devices 12 per section 30, however a section may comprise two or more layers of elastic devices 12, whereby the elastic devices 12 are attached to one another via their respective front sides, for example by gluing. In such an embodiment the elastic devices 12 are arranged on top of one another.

In another embodiment of the invention a pocket may comprise two or more elastic members 18, arranged on top of one another, but still embedded in the same pocket.

The furniture device may be embodied in the form of the holding member 22 is a flexible thread or string.

The flexible thread or string may be directly attached to the elastic member 18 via the connecting portions 24.

Alternatively the flexible thread or string may be directly attached to the pocket 14 via the connecting portions 24.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A furniture device configured to receive the weight of a being, said furniture device having a holding arrangement and at least one section comprising a base, a movable plate element, a moving mechanism and at least one elastic device, the plate element being configured to interact with the at least one elastic device and to be moved by the moving mechanism in respect to the base in order to adjust the firmness of the at least one elastic device, the elastic device comprising a pocket made of a fabric, and an elastic member, the elastic member being arranged within said pocket, the pocket being attached to adjacent pockets whereby the attachment is formed so that adjacent elastic devices may move independently from one another along a first distance, as measured from a free end of the elastic device and in a direction perpendicular to the plate element, the holding arrangement comprising a connecting portion and a holding member, which is connected to the at least one elastic device via the connecting portion, such that the at least one elastic member is compressed and relaxed respectively over its entire length during movement of the plate element upwards and downwards, the connecting portions being arranged on a straight line, which extends through the center of two or more attached elastic devices characterized in that the holding member is a flexible thread or string, which extends from the base to directly connect to each connecting portion and back from the connecting portion to the base thereby forming a V-shape with peaks and valleys.

2. The furniture device according to claim 1, wherein the holding member is connected to the base.

3. The furniture device according to claim 1, wherein the holding member is connected to the plate element.

4. The furniture device according to claim 1, wherein the elastic members are helical springs.

5. The furniture device according to claim 1, the elastic device having a length, as measured perpendicular to the plate element, wherein the first distance is larger or equal to 1/15 of the length and smaller or equal to 2/3 of the length.

6. The furniture device according to claim 1, wherein the holding member connects to multiple connecting portions.

7. The furniture device according to claim 1, wherein the connecting portions are at least one of:

passages in the pocket, welding seams between adjacent attached pockets, and glued seams between adjacent attached pockets.

8. The furniture device according to claim 1, wherein the connecting portions are directly formed on the elastic member or on the pocket.

9. The furniture device according to claim 1, wherein the elastic device comprises more than one elastic member and correspondingly more than one pocket, the elastic member and corresponding pocket being arranged on top of each other.

10. The furniture device according to claim 1, wherein the pockets are welded together in one horizontal direction and glued together in another horizontal direction.

11. The furniture device according to claim 1, wherein the furniture device is a bed or a mattress comprising a plurality of sections.

12. The furniture device according to claim 1, wherein the pockets are attached to adjacent pockets in a manner so that they are not attached to one another along a second distance as measured from the plate element in a direction perpendicular to the plate element and wherein the second distance is bigger or equal to 1/15 of the length of the elastic device.

13. The furniture device according to claim 1, wherein each section comprises a singular elastic device.

14. The furniture device according to claim 1, wherein the section comprises a layout of 6 times 13 elastic devices.

15. The furniture device according to claim 1, wherein the holding member is weaving from one connecting portion through the plate element to the base, where it is attached and back through the plate element to another connecting portion.

* * * * *